United States Patent [19]

Lener

[11] Patent Number: 4,852,845

[45] Date of Patent: Aug. 1, 1989

[54] HANGER CLAMP WITH INCLINED FRAME

[75] Inventor: Lawrence I. Lener, Springfield, N.J.

[73] Assignee: Lenox Incorporated, Lawrenceville, N.J.

[21] Appl. No.: 163,641

[22] Filed: Mar. 3, 1988

[51] Int. Cl.[4] ..... A47F 5/00

[52] U.S. Cl. ..... 248/316.1; 24/460; 24/513; 24/521; 211/89; 211/124; 206/291

[58] Field of Search ..... 248/316.1, 316.5, 316.6, 248/316.7; 24/460, 513, 515, 521; 211/89, 124; 206/289, 290, 291, 293, 279

[56] References Cited

U.S. PATENT DOCUMENTS

| | | | |
|---|---|---|---|
| Re. 31,075 | 11/1982 | London et al. | 190/41 |
| 341,365 | 5/1886 | Wilson . | |
| 561,376 | 6/1896 | Crawford . | |
| 743,454 | 11/1903 | Cohn . | |
| 1,114,775 | 10/1914 | Larson . | |
| 1,436,108 | 11/1922 | Owens . | |
| 1,604,717 | 10/1926 | Pflantzer . | |
| 1,630,031 | 5/1927 | Rogers . | |
| 1,835,632 | 12/1931 | Buhrke . | |
| 1,948,019 | 2/1934 | Ballentine | 206/287 |
| 2,352,102 | 6/1944 | Johnston . | |
| 2,479,634 | 8/1949 | Marques et al. . | |
| 2,545,211 | 3/1951 | Platt | 206/282 |
| 2,551,515 | 5/1951 | Tschirf . | |
| 2,689,631 | 9/1954 | Marks . | |
| 3,221,848 | 12/1965 | O'Neil . | |
| 3,531,835 | 10/1970 | Paikin . | |
| 3,542,170 | 11/1970 | Biale | 190/41 |
| 3,566,456 | 3/1971 | London | 206/279 |
| 3,958,675 | 5/1976 | Rosenblum | 190/43 |
| 4,046,363 | 9/1977 | Whitley | 269/228 |
| 4,139,102 | 2/1979 | Winton | 211/124 |
| 4,252,220 | 2/1981 | London et al. | 206/287 |
| 4,266,705 | 5/1981 | Wheeler | 294/163 |
| 4,363,388 | 12/1982 | London et al. | 206/287 X |
| 4,618,058 | 10/1986 | Gregg et al. | 206/291 |
| 4,640,414 | 2/1987 | Mobley et al. | 206/279 X |
| 4,732,270 | 3/1988 | Myers et al. | 211/214 X |
| 4,753,342 | 6/1988 | Pulichino, Jr. et al. | 248/316.1 X |
| 4,769,878 | 9/1988 | Liao | 24/535 |

FOREIGN PATENT DOCUMENTS

| | | |
|---|---|---|
| 2533647 | 2/1977 | Fed. Rep. of Germany . |
| 2949339 | 6/1981 | Fed. Rep. of Germany . |
| 61-160616 | 7/1986 | Japan . |
| 0517893 | 2/1940 | United Kingdom . |
| 1122257 | 8/1968 | United Kingdom . |
| 1280620 | 7/1972 | United Kingdom . |

*Primary Examiner*—Ramon O. Ramirez
*Attorney, Agent, or Firm*—Steele, Gould & Fried

[57] ABSTRACT

An improved clamp for retaining garment hangers in garment bags of the type having a rigid frame in the shape of a "C" with a top leg, a rear leg and a bottom leg, the top leg and bottom leg being spaced, is arranged such that the bottom leg is inclined downwardly toward a front of the clamp, defining a widening opening toward the front. A clamp bar having a conical eccentric protrusion complementary to the bottom leg is rotatably mounted in the frame between the rear leg and a distal end of the top leg. Users change between an open position wherein the eccentric portion of the clamp bar is turned to one side and thus spaced from the bottom leg, and a closed position wherein the eccentric protruding part of the clamp bar bears against the bottom leg, clamping the hangers in place. The eccentric clamp bar rotates on an axis in a common plane with the lower leg.

10 Claims, 2 Drawing Sheets

HANGER CLAMP WITH INCLINED FRAME

BACKGROUND OF THE INVENTION

1. Field of the Invention

This invention relates to an improved garment hanger clamp for a garment bag, to hold hangers in place when the garment bag is in transit. In particular, the invention is a clamp of the type having a rigid C-shaped frame and a rotatable bar therein, with an eccentric protruding portion on the bar that can be rotated to bear against the lower leg of the C-shaped frame, and wherein the lower leg of the frame is inclined relative to horizontal.

2. Prior Art

The prior art includes many variations of garment bags and other pieces of luggage designed to retain hangers carrying garments. It is desirable that the garment stays on its hanger and that the hanger stays on the retainer, placed at one end of the garment bag. However, in practice, garments frequently slip off the hangers during transit, and the hangers slip off the usual simple retaining mechanisms provided in garment bags. Certain prior art retainers require a special type of hanger, for example having a pivotable hook end which can be rotated clear of a special retention mechanism, as shown in U.S. Pat. No. 2,545,211—Platt. Clamps are also known for clothes hangers of the conventional type, i.e., having a body portion of wire, wood or plastic dimensioned to resemble a person's shoulders, and a central upper wire hook, to be placed over a closet bar or the like in normal use. Some form of catch or clamp engages with the hook of the hangers.

Notwithstanding special hanger structures and various clamps to engage hanger hooks and retain clothes hangers at one end of a garment bag, the hangers still have a way of coming loose. The hangers either fall free of their retainers or drop their garments due to displacement of the hangers in the garment bag. After a trip the user finds his or her garments wadded in the bottom of the garment bag.

Hanger retaining clamps have been proposed in a number of different structural arrangements, most frequently characterized by hingeably attached jaws. U.S. Pat. No. 3,566,456—London teaches clamping the vertical shank portion of hangers with jaws applied just below the hanger hooks. Two elongated jaws are hinged to one another on a vertical pivot axis, and a bail clip on one jaw is rotated around the distal end of the other jaw to clamp the hangers. Another example is U.S. Pat. No. 1,948,019—Ballentine. When these clamps are closed they keep the hangers from moving or dropping off the clamp. However, it can be quite difficult to manipulate hangers on and off the clamping mechanism. As a practical matter, such shank clamping devices are only openable when the garment hangers are all hanging from a closet bar. As a result the hooks of all the hangers must individually protrude from the garment bag.

In U.S. Pat. No. 4,252,220 (and U.S. NO. Re. 31,075)—London et al., the hinging axis is rotated ninety degrees relative to London '456, such that one of the elongated jaw members is rigidly attached to the top of a garment bag and the other of the jaw members hinges up and down on a horizontal pivot axis. A bail-type clasp holds the jaws together on the hangers, at an uppermost point in the hanger hook rather than on the shank.

Inasmuch as the lower jaw of the London '220 clamp hinges up and down on a horizontal axis, a problem is encountered. When the lower jaw is released and allowed to fall, the hangers on the lower jaw fall off the clamp. A user can deal with this problem by taking care not to open the jaws unless the hangers are independently supported. According to U.S. Pat. No. 4,363,388—London et al., means are provided for limiting the maximum angle at which the jaws of such a clamp can be opened. Therefore, the lower jaw, which when opened slants downwardly from the pivot axis (up to 15 degrees), stays close to the upper jaw. A bail-type closure at the distal end of the jaws has enough span to extend across the opening between the jaws. ..The opening- allows room to move the hangers around before closing the clamp.

U.S. Pat. Nos. 4,618,058—Gregg and 4,640,414—Mobley et al., go a step further. Rather than clamp the hangers between a movable lower jaw and a stationary upper jaw fixed to the garment bag as in London '388 and the like, the Gregg and Mobley patents teach a stationary horizontal lower jaw and a movable upper jaw. The stationary jaw is the lower leg of a rigid C-shaped frame, whose upper leg is fixed to the garment bag. The movable upper jaw is an intermediate member between the top and bottom legs of the C-shaped frame, and hinges downwardly against the hangers on the lower frame leg (jaw). The jaws are forced together by pushing a pivoting locking member against the top leg of the frame rather than by pulling the jaws together with a bail. The pivoting locking member is hinged to the front, distal end of the intermediate movable jaw. The locking member has an eccentric portion that bears against the upper C-frame leg to force the intermediate jaw against the lower C frame leg, thereby clamping the hangers. A spring bias means can be included to urge the intermediate jaw open when the locking member is disengaged. Inasmuch as the lower jaw, which forms the primary support structure for the hangers, is immovable and horizontal, the hangers do not fall off the clamp when the jaws open. On the other hand, the arrangement has inherent drawbacks. In order to function as described, it is necessary to have three relatively movable parts and a spring, namely the rigid C-shaped frame, the intermediate jaw and the locking member, all of which are relatively movable, and a spring which biases the intermediate jaw upward to open. If a user omits the biasing spring, then gravity normally urges the intermediate jaw to close against the stationary lower jaw, whereby two hands are required in order to manipulate the locking clamp and make room for the hangers.

According to U.S. patent application Ser. No. 163,642 of Rino Mazzanti, filed Mar. 3, 1988 entitled "HANGER RETAINING CLAMP FOR GARMENT BAGS", a clamp for retaining hangers includes a rigid C-shaped frame with a lower leg for supporting hangers, but the part movable against the lower leg is an elongated eccentric bar in the plane of the frame rather than a hinged jaw with an additional locking member articulated thereto. The number of moving parts is reduced to a minimum, while retaining beneficial features including the stationary C-frame with fixed lower member for supporting hangers. According to the Mazzanti invention, it is not necessary to spring bias a jaw member toward its open position. No relatively movable articulated locking tab is necessary. Mazzanti has abandoned the conventional technique of hingeably attaching jaw members by one end and providing means locking them together at their opposite end. In place of elongated hinged jaws as in the art, Mazzanti's eccentric clamping bar rotates on an axis in a plane including the lower leg of the C-frame such that an eccentric protrusion of the clamping bar is rotated downwardly toward the lower leg of the C-frame, whereupon the hangers are clamped. Upon rotating the clamping bar to move its eccentric upwardly, the lower leg of the C-frame is made fully accessible and will receive and support hangers.

The prior hanger clamps such as disclosed in the London, Mobley and Gregg patents are substantially improved by the Mazzanti invention wherein the movable clamping mechanism within the rigid C-shaped frame is an eccentric clamping bar instead of hinged elongated jaws. Nevertheless, like the prior art arrangements, the Mazzanti invention supports the hangers along a precisely horizontal support defined by the lower leg of the C-frame. It is presently preferred in connection with hanger clamps for garment bags that the horizontal span of the clamp be relatively short, for example about 3 cm. By orienting the lower frame leg at horizontal according to the art, there is relatively little vertical space in the clamp when opened, and the hangers must be placed relatively close to one another along the lower frame leg. The user, whose view of the clamp area may be obstructed, is prone to overlap the hangers and otherwise to entangle the hangers and the clamp. Individual hanger receptacle slots can be formed in the lower leg of the C-frame, but this does not entirely solve crowding problems. If a relatively large number of hangers (e.g. 8) are included in the short horizontal span (e.g. 3 cm), the individual hangers must be quite close together (0.375 cm or 0.15 inch). Frequently the hangers and/or garments are as thick as the allowed spacing between the hangers. The result is that the hangers are overcrowded and difficult to handle, with an added tendency for the hangers to be dropped from the clamp and/or for the garments to come off the hangers.

The present invention avoids these drawbacks in the horizontal lower frame member by inclining the lower frame member to incline downwardly towards its distal end. Preferably the rotation axis of the clamp bar is horizontal and thus the radial distance to the eccentric contact surface of the clamp bar increases proceeding toward the front of the clamp. At the front or distal end of the lower frame leg (i.e., at the extreme end of the clamp opening), there is a relatively large space defined between the lower frame leg and the rotatable clamp bar. Also by virtue of the inclined lower leg, hangers placed further back into the clamp are higher than the hangers residing toward the front. The hangers are relatively more spread out on the inclined lower leg of the C-frame, such that the user can see, feel and manipulate the hangers much more easily through the wide unobstructed front opening.

One consideration leading the prior art to change from a hinged leaf arrangement to a rigid frame was to avoid the situation wherein the lower member of a jaw-type clamp dropped downwardly when opened, thereby spilling the hangers from the clamp. Accordingly, the Mobley and Gregg patents specifically teach that the lower frame leg should be substantially non-inclined and horizontal. The present invention does not use conventional jaws at all, and moreover, the lower frame leg retains hangers notwithstanding the incline. A clamp pad or like structure on the lower leg has a plurality of individual hanger-receiving depressions. The individual depressions are deep enough that the hangers, normally of approximately 12 to 14 gauge wire, tend to remain in the individual depressions. It is presently preferred that the depth of the individual depressions in the resilient clamp pad be approximately half the diameter of the wire hangers expected to be received therein. The depth is preferably such that even the thinnest expected hanger extends somewhat above the edges of the respective depression in the resilient pad and thus comes into contact with the clamping bar. Accordingly, the wire of the hanger remains suitably clamped and captive.

As a result of the incline of the stationary lower frame leg, the rotatable clamping bar bearing down on the resilient clamping pad on said leg is made to have a substantially larger protruding eccentric portion adjacent the distal end of the C-frame legs. The span of the protrusion at the proximal end, namely at the back of the C-frame, is substantially the same as in the Mazzanti horizontal support clamp. Therefore, the user is provided with greater access and visibility with respect to the hangers. The hangers are positively clamped when the clamp is closed and do not readily spill off the lower frame member even when the clamp is open.

SUMMARY OF THE INVENTION

It is an object of the invention to improve on the construction of a garment hanger clamp of the type having a rigid C-frame and eccentric clamp bar, by improving the user's access to hangers in the clamp.

It is another object of the invention to improve the ease of operation of a hanger clamp of the eccentric bar type such that the device can easily be operated with one hand, including manipulation of the hangers and the clamp mechanism.

It is a further object of the invention to more widely space hangers in a clamp without increasing the horizontal extension of the clamp.

It is yet another object of the invention to employ the benefits of eccentric clamps for garment hanger retaining mechanisms and the benefits of jaw clamps, while minimizing their respective drawbacks.

These and other objects are accomplished by an improved clamp for retaining garment hangers in garment bags of the type having a rigid frame in the shape of a "C" with a top leg, a rear leg and a bottom leg, the top leg and bottom leg being spaced, the frame being mountable at the top inner wall of a garment bag for receiving garment hangers by their wire hook ends, and including an eccentric clamp bar rotatably carried in the frame between the rear leg and a distal end of the top leg, the improvements including the bottom leg being inclined downwardly toward the front of the clamp, defining a span becoming larger towards the front when the clamp is opened, and the eccentric clamp bar having a larger diameter towards said front to bear on the bottom leg when the clamp is closed. A hanger receiving groove formation preferably retains the hangers in grooves when the clamp is opened.

BRIEF DESCRIPTION OF THE DRAWINGS

There is shown in the drawings the embodiments that are presently preferred. It should be understood, however, that the invention is not limited to the precise arrangements and instrumentalities shown, and further-more that the invention is subject to embodiment in other groupings of specific features. The drawings are intended to be illustrative rather than limiting.

DETAILED DESCRIPTION OF THE PREFERRED EMBODIMENTS

Figure 1:
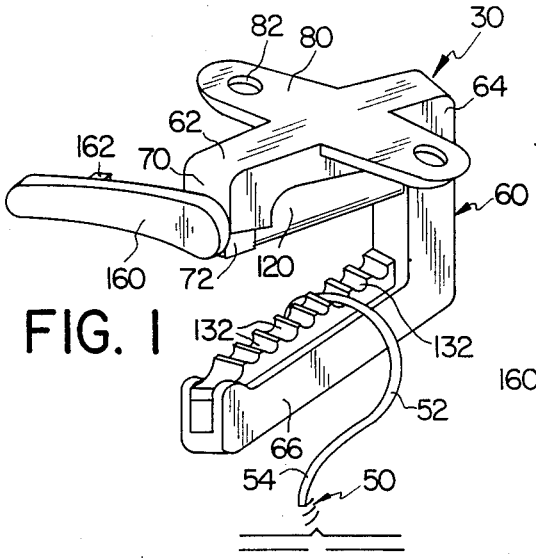
FIG. 1 is a perspective view of the garment hanger clamp of the invention, with a hanger hook shown in place and the clamp bar being open.
Figure 2:
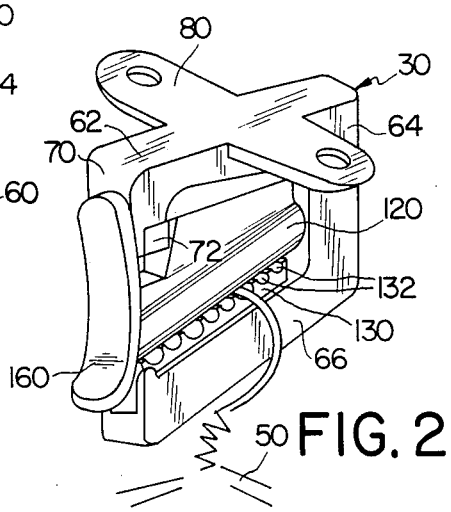
FIG. 2 is a perspective view corresponding to FIG. 1, but with the clamping bar shown rotated closed.

Clamp 30 is shown generally in FIGS. 1 and 2, in open and closed positions, respectively. Clamp 30 comprises a substantially rigid frame 60 generally in the shape of a "C" with a downwardly inclined lower leg 66. The frame carries a rotatable clamping bar 120 which can be turned on an axis in a common plane with the lower leg. Turning bar 120 brings an eccentric protrusion 128 of bar 120 against an upper surface of lower leg 66. Frame 60 also includes means for mounting the frame to a support, including mounting wings 80 extending in opposite directions from frame 60 and including attachment means 82 for fixing the wings to the top wall of a garment bag or the like. Garment hangers 50 can be hung on leg 66 and thereby supported in the garment bag by their hooked upper ends 52, the garments being disposed on the hangers, at and below shank 54. A plurality of hangers 50 are supportable on clamp 30 and when the clamp is closed each hanger is positively clamped in place.

The C-shaped frame 60 has a top member 62, rear member 64 and bottom member 66, rigidly attached together and to mounting wings 80. The bottom leg 66 is provided with a pad 130, for example of rubber or plastic, including a plurality of depressions 132 in which the hooked ends 52 of hangers 50 will reside when placed. The C-shaped frame 60 provides the basic mechanical support for the hangers 50, and must be sufficiently strong to withstand the weight of the hangers and the mechanical forces expected. It will be appreciated that the total weight of hangers in the garment bag is not likely to exceed about fifty pounds, however, it is preferred to provide a sufficiently strong frame 60 to withstand at least 200 pounds placed at the distal end of the lower frame member. A sufficiently strong frame member can be made from steel or plastic. Preferably, however, the frame member is cast integrally of a metal alloy, for example that sold as Zamak, comprising ninety-five percent zinc, four percent aluminum and one percent copper, which after casting is nickel plated. It is also possible to make the frame, pad and/or the rotatable clamping bar of a durable plastic.

The clamp 30 is opened and closed by rotating clamp bar 120 using finger tab 160, rigidly attached to the rotatable bar 120 at the front. It is also possible to place finger tab 160 at other locations along bar 120, for example the rear, however, front placement makes tab 160 most accessible to the user and the tab is always clear of the hooked ends 52 of hangers 50.

Figure 5:
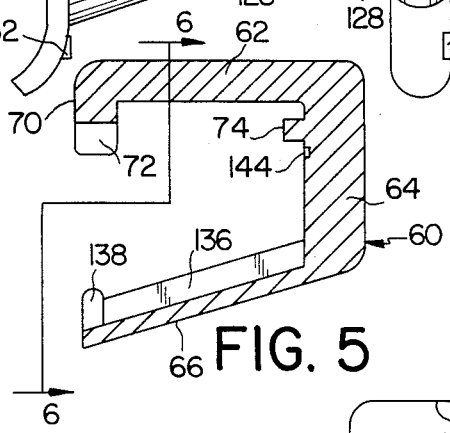
FIG. 5 is a partial section view of a C-frame member from the clamp according to FIG. 1 or FIG. 2.

Clamp bar 120 is journalled to the frame 60 such that bar 120 is rotatable around an axis in the plane of frame 60. Clamp bar 120 has an eccentric protrusion 128 which forms a contacting member that bears downwardly on hooks 52 of the hangers 50 when bar 120 is rotated closed, counter clockwise in the embodiments shown in FIGS. 1 and 2. Bar 120 is journalled to the frame, i.e., rotatably fixed to the frame in the manner of an axle and cylindrical opening therefor in one or the other of the bar and frame. The journalling can be accomplished in a number of alternative ways. For example, the bar 120 can be journalled only at the rear leg 64 of rigid C-shaped frame 60. Alternatively, the bar can be fixed along an intermediate area of the upper frame member 62. Preferably, clamping bar 120 is journalled at both the rear frame leg 64 and the distal end 70 of upper frame member 62. A cylindrical bore at the rear end of clamping bar 120 receives a pin 74 extending forward from the inner face of rear leg 64 of the frame. Pin 74, shown in FIG. 5, is integral with the rear leg 64, and thus does not detract from the strength of the rear leg. Due to the leverage exerted by a weight such as a heavy garment hung at the distal end of the lower leg 66 of frame 60, rear leg 64 is preferably substantially solid.

Clamping bar 120 is also preferably rotatably fixed to the upper frame leg 62, for example at the distal end 70 of leg 62. A yoke 72 is defined by a pair of tabs forming a partial enclosure for journalled mounting of an axle-like segment 126 of clamp bar 120, shown in FIG. 3. Bar 120 is preferably an integrally molded arrangement including an eccentric contacting member 128 facing downwardly towards the lower leg 66 of frame 60 when the apparatus is closed as shown in FIG. 2, and rotatable away from lower leg 66 when the device is open as shown in FIG. 1. Axle member 126 is defined toward the front of the bar and finger tab 160 extends eccentrically from axle portion 126, for manual manipulation of the clamping bar 120. A stop 162 abuts against lower leg 66 and prevents over-rotation of the clamping bar from the closed position shown in FIG. 2.

The two tabs of yoke 72 are deformed around the axle portion 126 of clamp bar 120 during assembly of the device, thereby axially fixing bar 120 to frame 60, between the distal end 70 and rear leg 64 of C-shaped frame 60, and allowing rotation of bar 120 in place.

In addition to tab 162, which fixes clamp bar 120 against over-rotation, a detent mechanism preferably retains bar 120 in one or more desired positions when placed there. It is possible to sufficiently tightly clamp axle portion 126 between the two ears of yoke 72 such that the clamp bar 120 will remain at the angular position last placed by the user due to friction. It is also possible to counter-balance the weight of the eccentric, at least partly, by placing a counteracting eccentric weight diametrically opposite from the eccentric 128. Preferably, yoke 72 does not restrict free rotation of clamp bar 120 and the eccentric 128 is not counterbalanced. Instead, a resilient detent is defined for retaining clamp bar 120 at least in an open position and preferably both in an open position and in a closed position.

Figure 6:
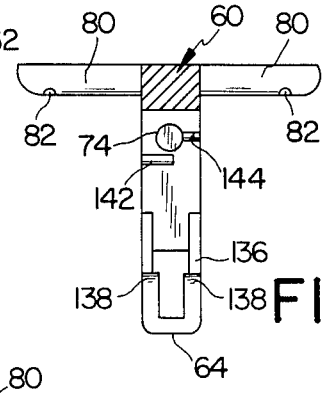
FIG. 6 is a section view taken along lines 6—6 in FIG. 5.
Figure 9:
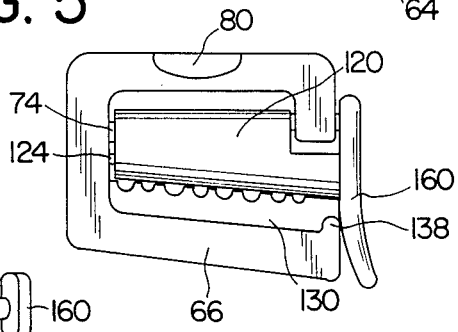
FIG. 9 is a side elevation view of the clamp of FIG. 2.
Figure 7:
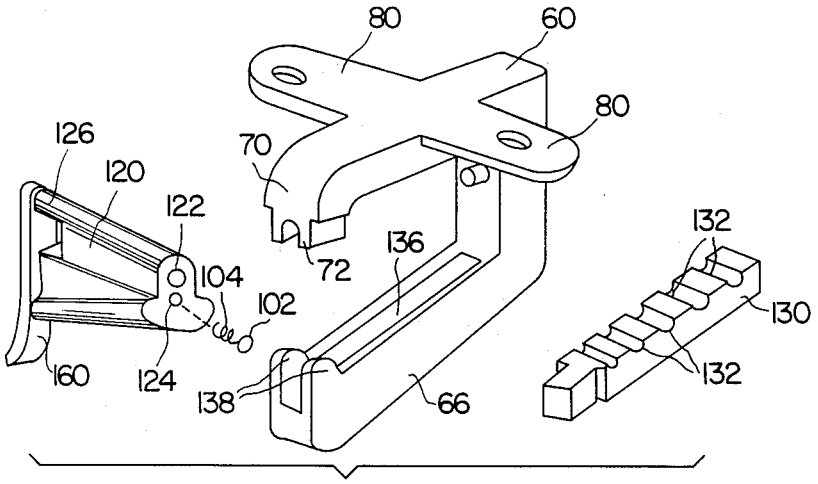
FIG. 7 is an exploded perspective view showing the respective of the clamp of the invention.

A preferred detent mechanism is shown in FIGS. 6 and 7. Clamp bar 120, which rotates due to bore 122 receiving pin 74, also has a bore 124 for a detent ball 102. Ball 102 protrudes slightly from bore 124 toward rear leg 64 of frame 60. Bore 124 is eccentric relative to the axis of pin 74. A resilient means such as helical spring 104 is disposed behind ball 102 in bore 124 and urges ball 102 against the inward facing wall of leg 64 of frame 60 when the device is assembled. One or more depressions 142, 144 are defined in the inner-facing wall of leg 64, at positions where ball 102 will be resiliently forced into depression 142, 144 and retain clamp bar 120 in position when fully closed and fully opened, respectively. Depressions 142, 144 are shown in FIG. 6. The depressions can be formed by slots extending inwardly from the sides of the C-frame rear leg 64. The slots should be deep enough to provide a secure detent, but not so deep that ball 102 is likely to escape from hole 124 in bar 120. Preferably the maximum protrusion of ball 102 is less than half its diameter.

Finger tab 160 as shown closes the opening between distal end 70 and the forward end of the lower leg 66 of frame 60 when the clamp is closed. It is not strictly required that tab 160 close this opening, because even without tab 160, the clamping bar 120 by its eccentric projection 128 will bear downwardly on hanger hooks 52, causing them to be securely retained on resilient pad 130, and particularly in depressions 132 thereon.

Resilient pad 130 is shown in the exploded view of FIG. 7. It will be noted that the forward end of pad 130 is narrower than the balance of pad 130, forming a step. The step fits into the corresponding stepped opening defined by channel 136. This locks pad 130 in channel 136 on the hanger-receiving side of the lower leg 66 of frame 60. Pad 130 cannot be displaced forwardly due to the step. A pair of locking ears 138 are provided on the distal end of lower leg 66. Ears 138 are forward of the stepped narrowing of channel 136 and are at narrower spacing than the rear portion of channel 136 at the front end of the clamp, retaining pad 130 in place. It is also presently preferred that pad 130 be adhesively fixed in channel 136.

Pad 130 need not be provided on the lower leg 66 of frame 60. It is also possible to arrange a resilient member on the eccentric protrusion 128 of clamping bar 120. Whether a resilient means is provided on leg 66, protrusion 128, or both, the result is that when bar 120 is rotated into the locked position as shown in FIG. 2, eccentric portion 128 comes into contact with the upper contact face of the lower frame leg, resiliently pushing hooks 52 of hangers 50 downward and into secure clamped engagement with the pad.

Figure 4:
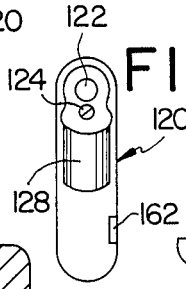
FIG. 4 is an end view of the clamping bar, from the right in FIG. 3.
Figure 8:
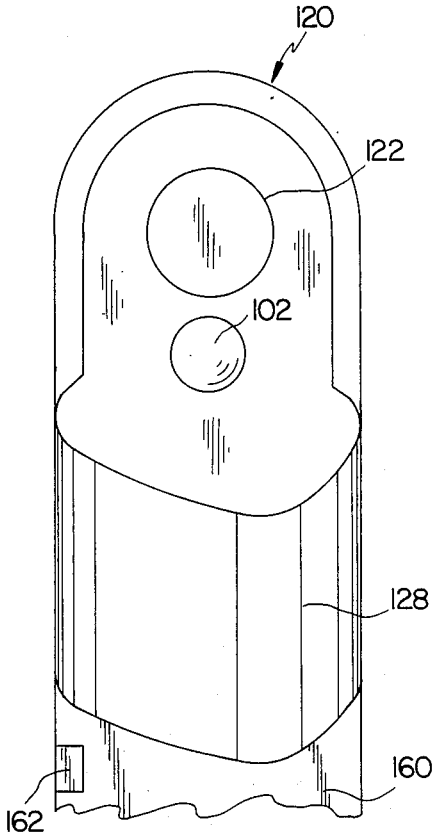
FIG. 8 is an enlarged end view of the rotatable clamping bar corresponding to FIG. 4 and showing the detail of the eccentric protrusion of the clamping bar defining a contact member.

As shown in FIGS. 4 and 8, the eccentric protrusion 128 is preferably not symmetrical around a center line of the axis defined by hole 122, pin 74 and yoke 72. Instead, eccentric protrusion 128 has a leading portion of a relatively lower curvature, toward the left in FIG. 8, and a trailing portion of a relatively higher curvature. In this manner, less added pressure per increment of rotation is exerted on pad 130 as the clamp bar 120 is rotated from its most open position downwardly; and near the point at which tab 162 contacts the outer edge adjacent locking ear 138, the curvature is such that pressure increases more per increment of rotation, clamping the hangers and giving the user a secure feeling of locking due to the pressure between protrusion 128 and pad 130, and not only due to the detent pin 102 falling into locking groove 142.

Figure 3:
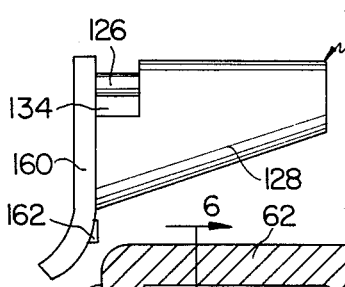
FIG. 3 is a side elevation view of a clamping bar apart from the C-frame.

According to the invention, the bottom frame leg 66 is inclined downwardly toward the front of frame 60 at least on the uppermost surface of leg 66. This defines a large opening at the front of the clamp for access by users. As a result, the radius defined by the eccentric protrusion of bar 120 as shown in FIG. 3 is progressively longer proceeding from the pivot axis towards the front. As compared to a device with a horizontal lower frame leg, the finger tab 160 must be longer, provided locking tab 162 is to be used to block overrotation. It is also possible to forego locking tab 162 and allow the tab to be substantially shorter than the span between the upper and lower frame legs.

FIGS. 3 and 4 show a suitable locking bar dimensioned to engage against the inclined lower frame leg in the closed position. The clamping bar of FIG. 3 includes the axle portion 126 and defined gap 134 of Mazzanti, around which the legs of yoke 72 are bent during assembly. A substantially larger contact portion 128 is disposed below axle section 126 as compared to Mazzanti's horizontal bar. The additional weight of the protruding eccentric portion of clamping bar 120 tends to encourage the clamping bar to rotate closed. The additional weight is opposed by the detent ball 102, which holds clamping bar 120 in the open or closed positions quite securely under the force of spring 104. As noted above, the weight can also be counterbalanced.

Figure 10:
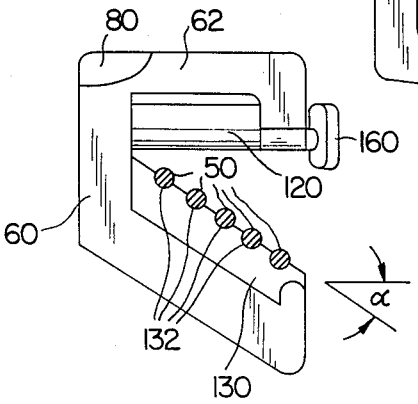
FIG. 10 is a side elevation view of an alternative embodiment with the supporting lower C-frame leg at a greater incline.

The specific angle of incline of the lower leg of C-frame is subject to some variation, being disposed of an angle of about 3°–20°, and preferably 6°, compared to horizontal. In FIG. 10, a steeper angle is shown. As a result of the more open nature of the clamp of the invention, the individual hangers as seen in the embodiment of FIG. 10 are easily visible to the user and their receptacle grooves 132 are fully accessible. The upper edge of the garments (not shown) hung from the hangers carried on the clamp bar in the embodiment of FIG. 10 are staggered such that the user can easily see whether the hanger being removed is the desired hanger, without completely emptying the hanger clamp.

Due to the hanger clamp having a tilting lower frame member, the eccentric rotatable clamp bar has an eccentric protruding clamping portion defining a conical surface of increasing radius toward the front of the clamp. The size of the clamp bar is increased. On the other hand, when the clamp is opened as in FIG. 1, the eccentric is rotated clear of the opening between lower leg 66 and clamp bar 120. Accordingly, the relatively large eccentric contact member does not interfere with access. On the contrary, the clamp with this larger clamp bar in fact opens wider than the strictly horizontal frames of Mazzanti, Gregg or Mobley, with improved results. Although inclined, the hangers are not prone to simply drop off the lower frame member, the device instead operating quite well to retain the hangers in place but to also facilitate their insertion and removal.

Referring to FIGS. 5 and 10, the lower frame leg 66 is of constant thickness along its length, wherefor the hanger-receiving upper surface and the lower surfaces are parallel and both inclined. It is possible to arrange leg 60 with a horizontal lower surface and an inclined upper surface. The contour of the upper surface can also be defined by pad 130, which can be of a thickness as needed for the required inclination to complement eccentric 128 of bar 120.

The embodiment of FIG. 10 has mounting wings 80 placed at the rear of the clamp. The structure for mounting frame 60 is subject to some variation, however, the mounting wings or the like preferably are positioned to oppose operational forces due to garment weights and user manipulations.

The invention is an improved clamp for retaining hangers of the type having a rigid frame member having a top leg, a rear leg and a bottom leg defining a general C-shape with a space between the top leg and the bottom leg, and, an eccentric clamp bar in the frame, rotatable on an axis and having an elongated contact member with a lower surface co-extensive with the bottom leg, the clamp bar being journalled to the frame member at least at one leg of the frame member, the clamp bar being rotatable on said axis between an open position in which the contact member is spaced from the bottom leg whereby hangers can be placed on the bottom leg, and a closed position in which the contact member is disposed against the bottom leg, whereby the hangers are clamped in place, the improvement comprising said bottom leg being tilted toward a front of the clamp and the contact member having a lower surface at a radially increasing space from the axis progressing toward the front, whereby the clamp defines an increasingly wider opening toward the front and the opening is unobstructed when the clamp is open.

The lower frame leg is tilted about 3° to about 20°, preferably about 6°. Receptacle slots are provided on the upper surface of the lower frame leg, possibly by means of a resilient pad on one or both of the leg and clamp bar, as a means for retaining hangers from sliding.

The invention as disclosed is subject to a number of variations that should now become apparent to persons skilled in the art aware of this disclosure. Reference should be made to the appended claims rather than the foregoing specification as indicating the true scope of the invention.

What is claimed is:

1. An improved clamp for retaining hangers of the type having a rigid frame member having a top leg, a rear leg and a bottom leg defining a general C-shape with a space between the top leg and the bottom leg, and, an eccentric clamp bar in the frame, rotatable on an axis and having an elongated contact member with a lower surface co-extensive with an upper surface of the bottom leg when the clamp bar is rotated closed, the clamp bar being journalled to the frame member at least at one leg of the frame member, the clamp bar being rotatable on said axis between an open position in which the contact member is spaced from the upper surface of the bottom leg, whereby hangers can be placed on and supported by the upper surface of the bottom leg, and a closed position in which the contact member is disposed against the upper surface of the bottom leg, whereby the hangers are clamped in place, the improvement comprising:

said upper surface of the bottom leg being inclined downwardly toward a front of the clamp and the contact member defining a lower surface at a radially increasing space from the axis progressing toward the front, whereby the clamp defines an increasingly wider opening toward the front and the opening is unobstructed when the clamp is open.

2. The improved clamp of claim 1, wherein the upper surface of the bottom leg of the frame member is tilted about 3° to about 20° relative to horizontal.

3. The improved clamp of claim 1, wherein the top leg and the bottom leg of the rigid frame member occupy a plane and the axis upon which the eccentric clamp bar is rotatable occupies the same said plane.

4. The improved clamp of claim 1, further comprising receptacle slots on the upper surface of the bottom leg for receiving hangers.

5. The improved clamp of claim 4, further comprising a resilient pad defining one of said upper surface of the bottom leg, and a lower surface of the contact member.

6. An improved hanger-retaining clamp of the type having a lower frame member upon which hangers can be placed such that the hangers are supported on an upper surface including the lower frame member, and a rotatable clamping bar having an eccentric protrusion movable against the upper surface of the lower frame member when the clamp is closed and rotatable clear of the lower frame member when the clamp is open, the clamping bar being rotatable on an axis in a plane of the lower frame member, the improvement comprising:

the upper surface of the lower frame member being tilted relative to horizontal such that a front end of the upper surface of the lower frame member is lower than a rear end of said upper surface; and, means on the upper surface of the lower frame member retaining hangers placed thereon from sliding.

7. The improved clamp of claim 6, further comprising a resilient pad disposed on the lower frame member and defining said upper surface of the lower frame member, the resilient pad being positioned such that the eccentric clamp bar bears against the resilient pad when the clamp is closed.

8. The improved clamp of claim 7, wherein the resilient pad has a plurality of depression slots disposed on said upper surface and oriented perpendicular to the axis of the eccentric clamping bar.

9. The improved clamp of claim 6, wherein the upper surface of the lower frame member slants at an angle of about 3°–20° relative to horizontal.

10. The improved clamp of claim 9, wherein the upper surface of the lower frame member tilts downwardly at an angle of about 6° relative to horizontal.

* * * * *

UNITED STATES PATENT AND TRADEMARK OFFICE

CERTIFICATE OF CORRECTION

PATENT NO. : 4,852,845

DATED : August 1, 1989

INVENTOR(S) : Lerner

It is certified that error appears in the above-identified patent and that said Letters Patent is hereby corrected as shown below:

On cover page of the above-issued patent, the inventor's name is spelled incorrectly. "Lawrence I. Lener" should be --Lawrence I. Lerner--.

Signed and Sealed this

Thirty-first Day of July, 1990

*Attest:*

HARRY F. MANBECK, JR.

*Attesting Officer*

*Commissioner of Patents and Trademarks*